US010539389B2

(12) United States Patent
Bartels et al.

(10) Patent No.: US 10,539,389 B2
(45) Date of Patent: Jan. 21, 2020

(54) STRING SUPPRESSOR

(71) Applicant: Hunter's Manufacturing Company, Inc., Suffield, OH (US)

(72) Inventors: Keith Bartels, Akron, OH (US); Michael Shaffer, Mogadore, OH (US)

(73) Assignee: Hunter's Manufacturing Co., Inc., Suffield, OH (US)

( * ) Notice: Subject to any disclaimer, the term of this patent is extended or adjusted under 35 U.S.C. 154(b) by 0 days.

(21) Appl. No.: 16/296,431

(22) Filed: Mar. 8, 2019

(65) Prior Publication Data

US 2019/0277596 A1 Sep. 12, 2019

Related U.S. Application Data

(60) Provisional application No. 62/640,087, filed on Mar. 8, 2018.

(51) Int. Cl.
*F41B 5/12* (2006.01)
*F41B 5/14* (2006.01)

(52) U.S. Cl.
CPC ..... *F41B 5/1426* (2013.01); *F41B 5/123* (2013.01); *F41B 5/1407* (2013.01)

(58) Field of Classification Search
CPC ..... F41B 5/10; F41B 5/123; F41B 5/1426
See application file for complete search history.

(56) References Cited

U.S. PATENT DOCUMENTS 2,092,361 A 9/1937 Shim
3,043,287 A 7/1962 Nelson
3,561,419 A 2/1971 Cucuzza, Sr.
3,670,711 A 6/1972 Firestone
3,739,765 A 6/1973 Moore
4,192,281 A 3/1980 King
4,246,883 A 1/1981 Ash
4,593,675 A 6/1986 Waiser
4,603,676 A 8/1986 Luoma
4,649,892 A 3/1987 Bozek
4,662,345 A 5/1987 Stephens
4,665,885 A 5/1987 Glomski et al.
4,719,897 A 1/1988 Gaudreau
(Continued)

OTHER PUBLICATIONS

A Guide to the Crossbow, by W.F. Paterson, published by the Society of Archer-Antiquaries, 1990.
(Continued)

*Primary Examiner* — John A Ricci
(74) *Attorney, Agent, or Firm* — Emerson Thomson Bennett, LLC

(57) ABSTRACT

Provided is a string suppressor for a crossbow comprising a first suppressor axis; a first suppressor plane containing the first suppressor axis; an elastomeric pad elongated along the first suppressor axis to define a first pad end, and a second pad end opposite the first pad end along the first suppressor axis; wherein the first pad end has a feature adapted for engagement with a crossbow riser; and wherein the second pad end has a string groove formed therein, the string groove being coextensive with the first suppressor plane, and has a cam groove formed therein, the cam groove being coextensive with the first suppressor plane, the cam groove being wide enough to provide a clearance fit with an associated cam.

12 Claims, 4 Drawing Sheets

(56) References Cited

U.S. PATENT DOCUMENTS

| | | | | |
|---|---|---|---|---|
| 4,721,092 | A | 1/1988 | Waiser | |
| 4,942,861 | A | 7/1990 | Bozek | |
| 5,115,795 | A | 5/1992 | Farris | |
| 5,205,267 | A | 4/1993 | Burdick | |
| 5,215,069 | A | 6/1993 | Liu | |
| 5,220,906 | A | 6/1993 | Choma | |
| 5,243,956 | A | 9/1993 | Luehring | |
| 5,433,186 | A | 7/1995 | Corwin | |
| 5,437,260 | A | 8/1995 | King | |
| 5,445,139 | A | 8/1995 | Bybee | |
| 5,553,596 | A | 9/1996 | Bednar | |
| 5,598,829 | A | 2/1997 | Bednar | |
| 5,649,520 | A | 7/1997 | Bednar | |
| 5,678,528 | A | 10/1997 | Hadley | |
| 5,853,001 | A | 12/1998 | Vyprachticky | |
| 5,987,724 | A | 11/1999 | Kleman | |
| 6,095,128 | A | 8/2000 | Bednar | |
| 6,286,496 | B1 | 9/2001 | Bednar | |
| 6,874,491 | B2 | 4/2005 | Bednar | |
| 6,913,007 | B2 | 7/2005 | Bednar | |
| 7,100,590 | B2 | 9/2006 | Chang | |
| 7,624,725 | B1 | 12/2009 | Choma | |
| 7,784,453 | B1 | 8/2010 | Yehle | |
| 8,033,277 | B2 * | 10/2011 | Gordon | F41B 5/1426 124/25.6 |
| 8,443,790 | B2 | 5/2013 | Pestrue | |
| 8,453,636 | B2 * | 6/2013 | Gordon | F41B 5/1426 124/1 |
| 8,499,753 | B2 | 8/2013 | Bednar | |
| 9,140,515 | B2 * | 9/2015 | Yi | F41B 5/1426 |
| 9,228,791 | B2 * | 1/2016 | Saunders | F41B 5/1426 |
| 9,234,719 | B1 | 1/2016 | Kempf | |
| 10,175,021 | B2 * | 1/2019 | McPherson | F41B 5/10 |
| 2006/0086346 | A1 | 4/2006 | Middleton | |
| 2010/0170488 | A1 | 1/2010 | Rasor et al. | |
| 2017/0184370 | A1 * | 6/2017 | McPherson | F41B 5/10 |

OTHER PUBLICATIONS

European Crossbows, A Survey by Josef Alm, copyrighted by the Trustees of the Royal Armouries and the Arms and Armour Society, 1994.

The Book of the Crossbow, by Ralph Payne-Gallwey, published by Dover Publications, Inc. of New York, 1995.

* cited by examiner

STRING SUPPRESSOR

CROSS-REFERENCE TO RELATED APPLICATIONS

This application claims the benefit of U.S. Provisional Application No. 62/640,087, filed Mar. 8, 2018, the entirety of which is fully incorporated by reference herein.

BACKGROUND

The present subject matter is directed to apparatuses and methods regarding crossbows. More specifically the present subject matter is directed to apparatuses and methods for a string suppressor for a crossbow.

Crossbows have been used for many years as a weapon for hunting and fishing, and for target shooting. Crossbows typically comprise a bowstring engaged through a set of pulleys or cams to a set of limbs and, optionally, to a set of power cords. The bowstring is operable between a cocked position and an uncocked position and in the course of a firing operation is discharged at firing speeds from the cocked position to the uncocked position.

One known issue affecting or relevant to crossbow operation is the bowstring undergoing post-firing vibration of the bowstring. It may be desirable to operation to reduce, minimize or eliminate post-firing vibration. It remains desirable to provide apparatus and methods adapted to reduce, minimize or eliminate post-firing vibration.

SUMMARY

Provided is a string suppressor for a crossbow comprising a first suppressor axis; a first suppressor plane containing the first suppressor axis; an elastomeric pad elongated along the first suppressor axis to define a first pad end, and a second pad end opposite the first pad end along the first suppressor axis; wherein the first pad end has a feature adapted for engagement with a crossbow riser; and wherein the second pad end has a string groove formed therein, the string groove being coextensive with the first suppressor plane, and has a cam groove formed therein, the cam groove being coextensive with the first suppressor plane, the cam groove being wide enough to provide a clearance fit with an associated cam.

BRIEF DESCRIPTION OF THE DRAWINGS

The present subject matter may take physical form in certain parts and arrangement of parts, embodiments of which will be described in detail in this specification and illustrated in the accompanying drawings which form a part hereof and wherein.

DEFINITIONS

Figure 1:
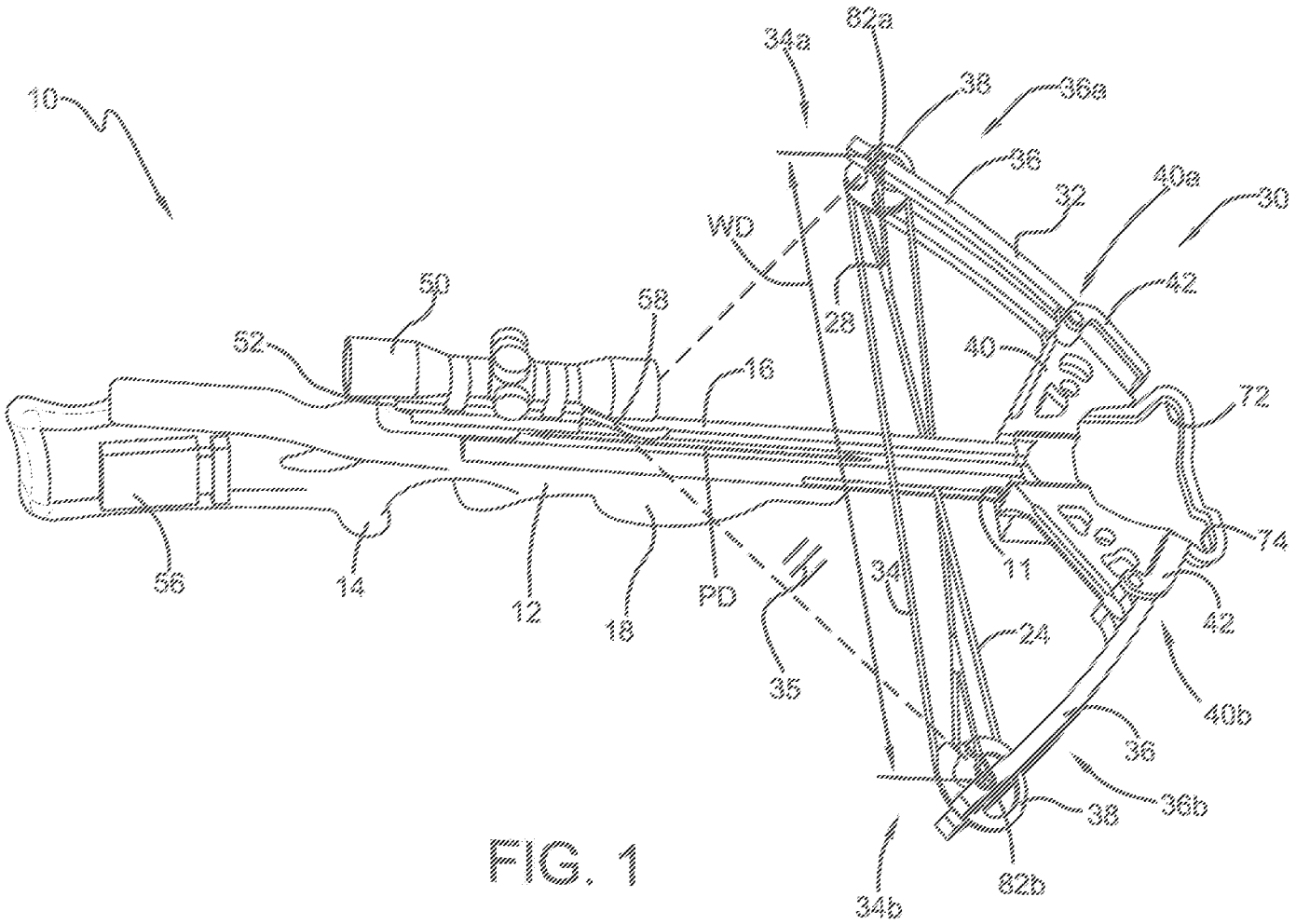
FIG. 1 is a view of one non-limiting embodiment of a conventional crossbow.

The following definitions are controlling for the disclosed subject matter:

"Arrow" means a projectile that is shot with (or launched by) a bow assembly.

"Bow" means a bent, curved, or arched object.

"Bow Assembly" means a weapon comprising a bow and a bowstring that shoots or propels arrows powered by the elasticity of the bow and the drawn bowstring.

"Bowstring" means a string or cable attached to a bow.

"Compound Bow" means a crossbow that has wheels, pulleys or cams at each end of the bow through which the bowstring passes.

"Crossbow" means a weapon comprising a bow assembly and a trigger mechanism both mounted to a main beam.

"Draw Weight" means the amount of force required to draw or pull the bowstring on a crossbow into a cocked condition.

"Main Beam" means the longitudinal structural member of a weapon used to support the trigger mechanism and often other components as well. For crossbows, the main beam also supports the bow assembly. The main beam often comprises a stock member, held by the person using the weapon, and a barrel, used to guide the projectile being shot or fired by the weapon.

"Power Stroke" means the linear distance that the bowstring is moved between the uncocked condition and the cocked condition.

"Trigger Mechanism" means the portion of a weapon that shoots, fires or releases the projectile of a weapon. As applied to crossbows, trigger mechanism means any device that holds the bowstring of a crossbow in the drawn or cocked condition and which can thereafter be operated to release the bowstring out of the drawn condition to shoot an arrow.

"Weapon" means any device that can be used in fighting or hunting that shoots or fires a projectile including bow assemblies and crossbows.

DETAILED DESCRIPTION

Referring now to the drawing FIGS. 1-4 wherein the showings are for purposes of illustrating embodiments of the present subject matter only and not for purposes of limiting the same, and wherein like reference numerals are understood to refer to like components, provided are a string suppressor and assembly.

FIG. 1 shows a crossbow 10. While the crossbow 10 shown uses a compound bow, it should be understood that this invention will work well with any type of crossbow chosen with sound judgment by a person of ordinary skill in the art.

The crossbow 10 has a main beam 12 which may include a stock member 14, and a barrel 16. The main beam 12 may be made by assembling the stock member 14 and the barrel 16 together as separate components or, in another embodiment, the main beam 12 may be made as one piece. A handgrip 18 may be mounted to the main beam 12 in any conventional manner chosen with sound judgment by a person of ordinary skill in the art. A trigger mechanism suitable for shooting an arrow is mounted to the main beam 12 in any suitable manner. It should be noted that the crossbow 10 may comprise any trigger mechanism chosen with sound judgment by a person of ordinary skill in the art. The crossbow 10 also includes a bow assembly 30 adapted to propel an associated arrow and having a bow 32 and a bowstring 34. The bow 32 may include a set of limbs 36, 36 that receive the bowstring 34 in any conventional manner chosen with sound judgment by a person of ordinary skill in the art. For the embodiment shown, a pair of wheels, pulleys, or cams 38, 38 mounted to the limbs 36, 36 receive the bowstring 34 in an operational manner. In each of the non-limiting embodiments, the set of limbs has a first limb set 36*a* and a second limb set 36*b* opposite the first limb set 36*a* with first limb set 36*a* being operationally engaged with a first cam 38 and second limb set 36*b* being operationally engaged with a second cam 38. The bow may also include a riser 40. The riser 40 may comprise a set of limb pockets 42, 42 adapted to receive the limbs 36, 36, as shown in FIG. 1 with the first limb set 36*a* engaged to a first riser side 40*a* and the second limb set 36*b* engaged to a second riser side 40*b*. The first limb set 36*a* may define a first limb axis 82*a* about which a cam 38 or cam set 240 may be rotatably engaged. The second limb set 36*b* may define a second limb axis 82*b* about which a cam 38 or cam set 240 may be rotatably engaged. In the non limiting embodiments shown in FIG. 1 the second limb axis 82*b* is parallel to the first limb axis 82*a*.

Without limitations, other crossbow components may be optionally used with a crossbow as provided herein. Without limitation, in some non-limiting embodiments, a crossbow 10 shown may include a scope 50 attached to a scope mount 52 that is supported on the main beam 12. Other optional components shown include a cocking unit 56, and arrow holder 58. In certain non-limiting embodiments, the riser 40 may have an opening 72 formed therein defining a foot stirrup 74 adapted for holding and balancing the crossbow by foot.

A crossbow 10 may have a power stroke distance PD. The distance between the pivot axes of the wheels, pulleys, or cams 38, 38 may be some distance WD.

Figure 2:
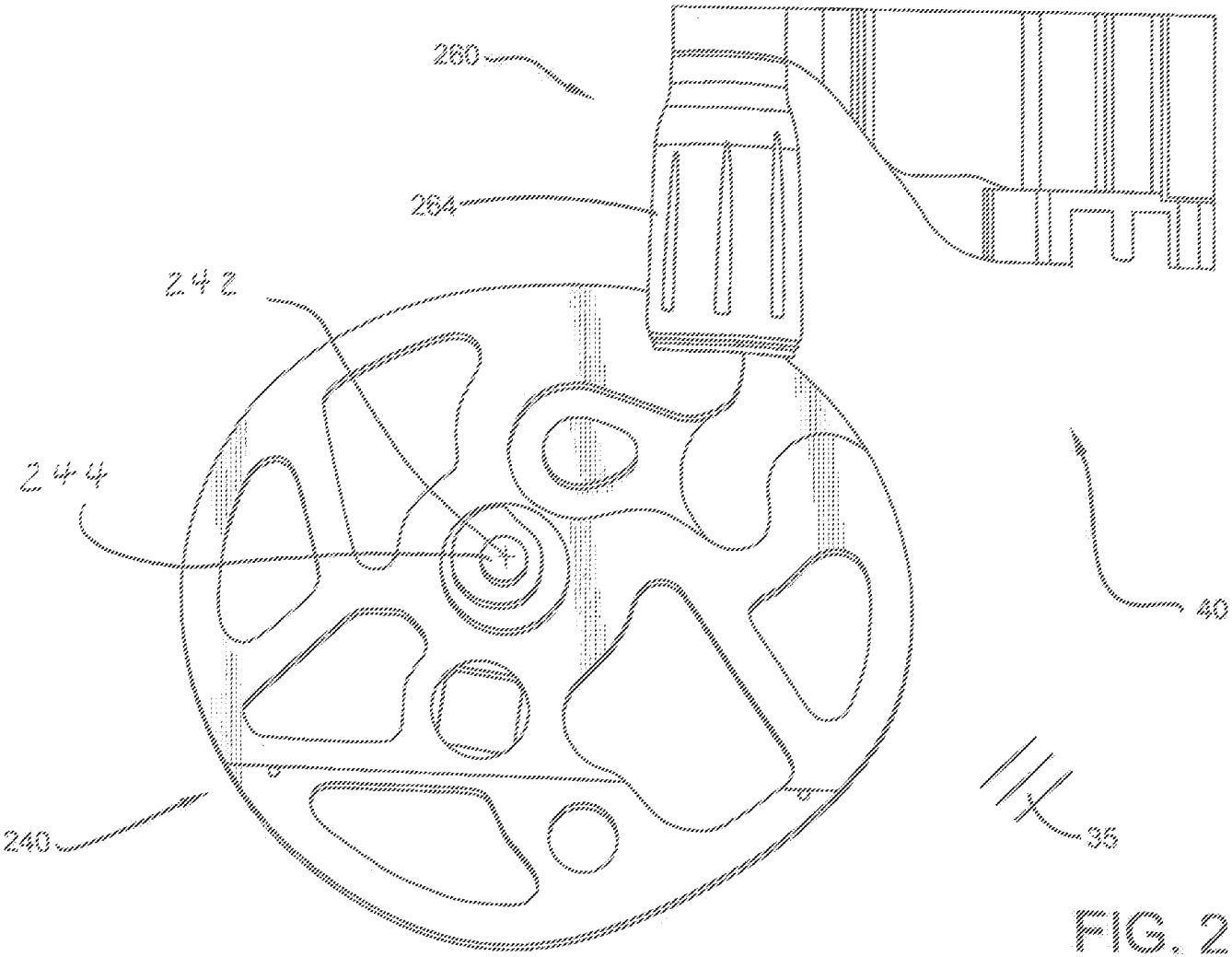
FIG. 2 is view of a first non-limiting embodiment of a string suppressor in operative engagement with a cam set.
Figure 3:
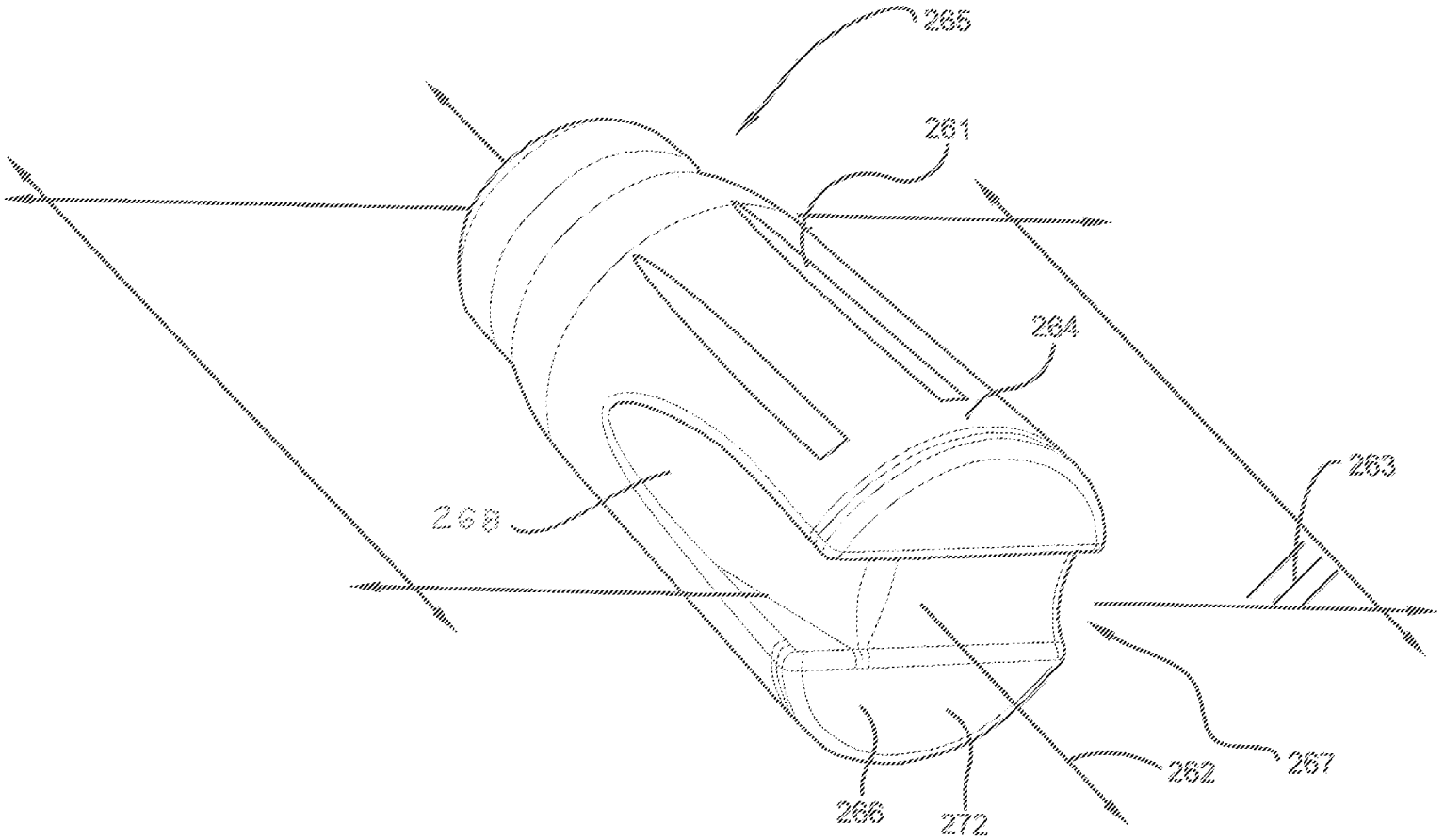
FIG. 3 is view of a first non-limiting embodiment of a string suppressor.
Figure 4:
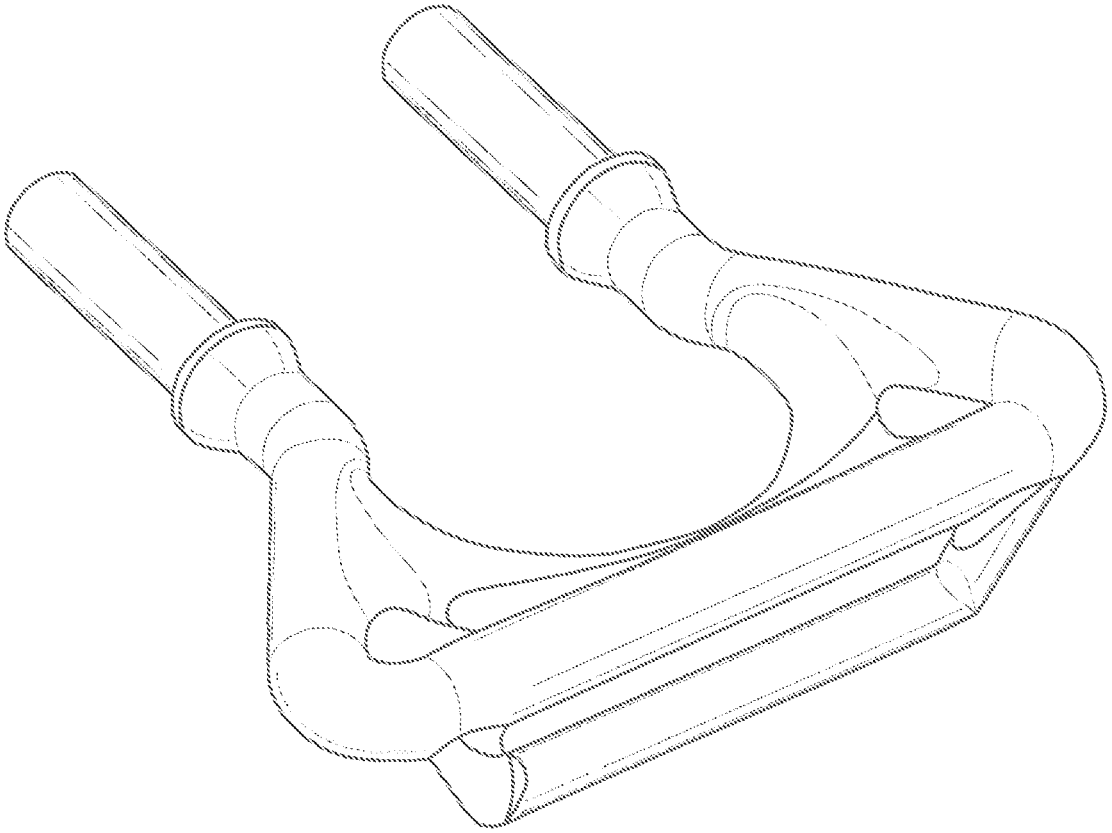
FIG. 4 is view of one non-limiting embodiment of a stirrup.

With reference to the non-limiting embodiment of a partial assembly shown in FIG. 2, a cam set 240 may be operationally engaged with a crossbow 10 in such a way that it is proximate to a string suppressor 260. In the non-limiting embodiment of FIG. 2, the string suppressor 260 is operationally engaged with the riser 40.

The string suppressor 260 may comprise a first suppressor axis 262, a first suppressor plane 263 and an elastomeric pad 264. The string suppressor may have a peripheral surface 261. The first suppressor plane 263 may contain the first suppressor axis 262. The elastomeric pad may be elongated along the first suppressor axis 262 to define a first pad end 265, and a second pad end 266 opposite the first pad end 265 along the first suppressor axis 262. The first pad end 265 may have a feature adapted for engagement with a crossbow riser 40. As will be further detailed herebelow, the feature of first pad end 265 adapted for engagement with a crossbow riser 40 may include one or more mechanical fasteners (not shown). The second pad end 266 may define a pad face 272, a string groove 267, and a cam groove 268. The second pad end 266 may have the string groove 267 formed therein and the string groove 267 may have a depth extending along the first suppressor axis 262. In certain non-limiting embodiments the string groove 267 may be elongated to extend across the pad face 272. In certain non-limiting embodiments the string groove 267 may be open to the pad face 272. In certain non-limiting embodiments the string groove 267 may be elongated within the first suppressor plane 263 or extend within the suppressor plane 263, or otherwise be coextensive with the suppressor plane. The string groove 267 may be wide enough to provide a clearance fit for a bowstring 34 therein. The second pad end 266 may have the cam groove 268 formed therein. In certain non-limiting embodiments the cam groove 268 may be elongated to extend at least partially across the pad face 272 and may extend along the first suppressor axis 262. In certain non-limiting embodiments the cam groove 268 may be open to the pad face 272 and may be open to the peripheral surface 261. In certain non-limiting embodiments the string groove 267 may be elongated within the first suppressor plane 263 or extend within the suppressor plane 263, or otherwise be coextensive with the suppressor plane 263. The cam groove 268 may be wide enough to provide a clearance fit with an associated cam 38 such as, without limitation a cam 38 of cam set 240.

Operational engagement of the string suppressor and the riser may be affected by a variety of means. In some non-limiting embodiments, the string suppressor 260 and the riser 40 may be joined with one or more mechanical fasteners (not shown) which may include, but are not limited, one or more bolts, nuts, clips, clamps, pins, or combinations thereof. In some embodiments, the string suppressor 260 and the riser 40 may be joined to be fixed, or substantially fixed with respect to one another. In some embodiments, the string suppressor 260 and the riser 40 may be joined to be slide with respect to one another along first suppressor axis 262. The string suppressor 260 may be engaged with the riser 40 such that the suppressor plane 263 coincides with a bowstring operation plane 35 as described more fully herebelow.

A crossbow may have multiple cam sets 240 with each cam set 240 having a shaft 242 defining a cam axis 244 and engaged with a limb 36 such that the cam axis coincides with the limb axis 82*a*, 82*b* for that limb 36. Each cam set 240 has a bowstring cam 38 operationally engaged with the shaft 242 to be rotatable about the cam axis 244. A crossbow 10 may have cams 38 with a bowstring 34 extending therebetween with a first end 34*a* of the bowstring 34 operationally engaged with the bowstring cam 38 on first side 36*a* and a second end 34*b* of the bowstring 34 operationally engaged with the bowstring cam 38 on first side 36*b*. The bowstring 34 is operable to be moved between a cocked bowstring position, and an uncocked bowstring position, wherein operative motion of the bowstring 34 between the cocked bowstring position and the uncocked bowstring position sweeps out a bowstring operation plane 35.

The string suppressor 260 may be engaged with the riser 40 and may have a first suppressor axis 262, and a first suppressor plane 263 containing the first suppressor axis 262 arranged such that the first suppressor plane 263 is coincident with the bowstring operation plane 35. The elastomeric pad may have the string groove 267 therein oriented along and coincident with the first suppressor plane 263 and the bowstring operation plane 35 such that post firing vibration of the bowstring carries at least a portion of the bowstring 34 into the string groove 267 and the bowstring 34 may impinge upon the string suppressor 260. As shown in FIG. 2, the cam groove 268 may provide clearance with the cam set 240 permitting string suppressor 260 to be mounted very close to the cam set 240 without interfering with operation.

Numerous embodiments have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof.

We claim:

1. A string suppressor for a crossbow comprising a first suppressor axis;

a first suppressor plane containing the first suppressor axis;

an elastomeric pad elongated along the first suppressor axis to define a first pad end, and a second pad end opposite the first pad end along the first suppressor axis;

wherein the first pad end has a feature adapted for engagement with a crossbow riser; and wherein the second pad end has a string groove formed therein, the string groove being coextensive with the first suppressor plane, and has a cam groove formed therein, the cam groove being coextensive with the first suppressor plane, the cam groove being wide enough to provide a clearance fit with an associated cam.

2. The string suppressor of claim 1 wherein, the elastomeric pad has a durometer in the range of Shore 40A to Shore 70A.

3. The string suppressor of claim 2 wherein, the elastomeric pad has a durometer in the range of Shore 50A to Shore 60A.

4. The string suppressor of claim 3 wherein, the elastomeric pad has a durometer in the range of Shore 54A to Shore 56A.

5. A crossbow comprising a bow having a riser having a first riser side and a second riser side opposite the first riser side, a first limb set engaged to the first riser side, and defining a first limb axis;

a second limb set, engaged to the second riser side, and defining a second limb axis parallel to the first limb axis;

a first cam set having a first shaft defining and rotatable about a first cam axis, first shaft engaged with the first limb such that the first cam axis coincides with the first limb axis, a bowstring cam of the first cam set operationally engaged with the first shaft to be rotatable about the first cam axis;

a second cam set having a second shaft defining and rotatable about a second cam axis, second shaft engaged with the second limb set such that the second cam axis coincides with the second limb axis;

a bowstring cam of the second cam set operationally engaged with the second shaft to be rotatable about the second cam axis;

an elongated bowstring having a first end of the elongated bowstring operationally engaged with the bowstring cam of the first cam set, and a second end of the elongated bowstring opposite the first end of the elongated bowstring operationally engaged with the bowstring cam of the second cam set, the bowstring being operable to be moved between a cocked bowstring position, and an uncocked bowstring position, wherein operative motion of the bowstring between the cocked bowstring position and the uncocked bowstring position sweeps out a bowstring operation plane;

a first string suppressor engaged with the riser having a first suppressor axis;

a first suppressor plane containing the first suppressor axis, the first suppressor plane being coincident with the bowstring operation plane;

an elastomeric pad elongated along the first suppressor axis to define a first pad end, and a second pad end opposite the first pad end along the first suppressor axis;

wherein the first pad end is operatively engaged with the crossbow riser; and wherein the second pad end has a string groove formed therein, the string groove being coextensive with the first suppressor plane, and has a cam groove formed therein, the cam groove being coextensive with the first suppressor plane, the cam groove being wide enough to provide a clearance fit with the bowstring cam of the first cam set.

6. The crossbow of claim 5 wherein, the elastomeric pad has a durometer in the range of Shore 40A to Shore 70A.

7. The crossbow of claim 6 wherein, the elastomeric pad has a durometer in the range of Shore 50A to Shore 60A.

8. The crossbow of claim 7 wherein, the elastomeric pad has a durometer in the range of Shore 54A to Shore 56A.

9. The crossbow of claim 5, further comprising a second string suppressor engaged with the riser.

10. The crossbow of claim 9 wherein, each elastomeric pad has a durometer in the range of Shore 40A to Shore 70A.

11. The crossbow of claim 10 wherein, each elastomeric pad has a durometer in the range of Shore 50A to Shore 60A.

12. The crossbow of claim 11 wherein, each elastomeric pad has a durometer in the range of Shore 54A to Shore 56A.

* * * * *